US008066019B2

(12) United States Patent
Zhu et al.

(10) Patent No.: US 8,066,019 B2
(45) Date of Patent: Nov. 29, 2011

(54) COSMETIC POWDER CONTAINER WITH ROTATING DISPENSING MECHANISM

(75) Inventors: Jing Zhu, San Francisco, CA (US); Sarina Godin, Oakland, CA (US); Jerome Fraillon, San Francisco, CA (US)

(73) Assignee: Bare Escentuals Beauty, Inc., San Francisco, CA (US)

( * ) Notice: Subject to any disclaimer, the term of this patent is extended or adjusted under 35 U.S.C. 154(b) by 706 days.

(21) Appl. No.: 12/157,696

(22) Filed: Jun. 12, 2008

(65) Prior Publication Data

US 2009/0308409 A1 Dec. 17, 2009

(51) Int. Cl.
*A45D 33/02* (2006.01)

(52) U.S. Cl. ..... 132/299; 132/298

(58) Field of Classification Search ..... 132/298, 132/299, 293–297; 401/123–125
See application file for complete search history.

(56) References Cited

U.S. PATENT DOCUMENTS

| | | | | | |
|---|---|---|---|---|---|
| 1,156,456 | A | * | 10/1915 | Beck | 132/298 |
| 1,690,275 | A | * | 11/1928 | Coryell | 132/298 |
| 2,746,462 | A | * | 5/1956 | Kasdan | 132/298 |
| 4,626,119 | A | * | 12/1986 | Ladd, Jr. | 401/123 |
| 4,630,955 | A | | 12/1986 | Ladd, Jr. et al. | |
| 4,647,240 | A | | 3/1987 | Ladd, Jr. et al. | |
| 4,671,690 | A | | 6/1987 | Ladd, Jr. et al. | |
| 4,974,981 | A | | 12/1990 | Bennett | |
| 6,457,891 | B1 | | 10/2002 | Bredacts | |
| 7,121,429 | B2 | | 10/2006 | Bartholomew et al. | |
| 2007/0017542 | A1 | | 1/2007 | Petit | |

FOREIGN PATENT DOCUMENTS

| | | |
|---|---|---|
| EP | 0 743 099 | 10/1997 |
| EP | 1 832 197 | 9/2007 |

* cited by examiner

*Primary Examiner* — Robyn Doan

(74) *Attorney, Agent, or Firm* — David R. Preston; David R Preston & Associates

(57) ABSTRACT

The present invention relates generally to the field of cosmetic powder containers and dispensers and particularly to a cosmetic powder dispenser with rotatable dispensing mechanism. The present invention is particularly easy to use and cost effective by allowing the consumer to dispense only the desired amount of the cosmetic powder by providing a rotating dispensing mechanism, and at the same time allow the consumer to apply the cosmetic evenly to the brush head by providing an application surface to manipulate the cosmetic brush evenly onto the brush head. Furthermore, the rotating dispenser of the present invention, includes and open and closed position as to safeguard the loose powder in the container from spilling out by accident or during use or travel.

9 Claims, 5 Drawing Sheets

COSMETIC POWDER CONTAINER WITH ROTATING DISPENSING MECHANISM

FIELD OF INVENTION

The present invention relates generally to the field of cosmetic powder containers and dispensers and particularly to a cosmetic powder dispenser with rotatable dispensing mechanism.

BACKGROUND OF THE INVENTION

A variety of cosmetic powder containers and dispensers are available on the market. Cosmetic powders are generally applied to the face by way of a variety of different types of brushes. To apply the cosmetic powder to the face, the cosmetic powder must first be applied to the brush and then applied to the face in a desired location and manner. Many of the available cosmetic powder container are simply a container for the cosmetic powder with a lid, which leaves the consumer with the task of figuring out how to apply the desired amount of cosmetic powder to the brush and then to the face. Cosmetics are generally expensive, and much of the powder can be wasted if too large of an amount of the powder is applied to the brush. A major difficulty with application of cosmetic powder to the face from a simple container is that a brush is usually dipped into the cosmetic powder and then applied to the face. There is usually little that can be done to even out the cosmetic powder on the brush head. Because dipping the brush head into the powder causes a varying amount of cosmetic powder to be picked up by different regions of the brush head, the application of the cosmetic powder may be uneven, especially if too large of an amount of the cosmetic powder was picked up by the brush head.

Many of the available cosmetic containers and dispensers suffer from the problems discussed above. While there has been a trend to produce more effective and cost saving cosmetic powder containers and dispensers, further improvements in effectiveness and ease of use for of the cosmetic powder container and dispenser is desirable, and the present invention addresses the existing problems and provides related solutions and benefits.

SUMMARY OF THE INVENTION

The present invention relates generally to the field of cosmetic powder containers and dispensers and particularly to a cosmetic powder dispenser with rotatable dispensing mechanism. The present invention is particularly easy to use and cost effective by allowing the consumer to dispense only the desired amount of the cosmetic powder by providing a rotating dispensing mechanism, and at the same time allow the consumer to apply the cosmetic powder evenly to the brush head by providing an application surface to manipulate the cosmetic powder evenly onto the brush head. Furthermore, the rotating dispenser of the present invention, includes and open and closed position as to safeguard the loose powder in the container from spilling out by accident or during use or travel.

The present invention recognizes that cosmetic powder containers and dispensers can be made more user friendly and cost effective by providing a cosmetic powder container with a rotatable dispensing mechanism to provide the ability to dispense only the desired amount of the cosmetic powder and at the same time provide an application surface for manipulating the cosmetic brush evenly onto the brush head.

A first aspect of the present invention includes a cosmetic powder container with rotating dispenser mechanism including a powder container capable of containing cosmetic powder, the powder container including a first open end and an opposing first closed end having a first peripheral side wall having attaching means for attachment to a removable lid; and a rotating dispenser mechanism including a dispensing cap including a second open end and an opposing second closed end having a second peripheral side wall, wherein the second closed end is adapted to fit inside the first open end and partially down the first peripheral side wall of the powder container, such that the first peripheral side wall and the second peripheral side wall are substantially coterminous at the first open end of the powder container, the second closed end of the dispensing cap further including a docking area having one or more recessed cavities and a dispensing area having one or more orifices; and a rotating cap including a third open end and an opposing third closed end having a third peripheral side wall, wherein the rotating cap is adapted to fit inside the second open end of the dispensing cap, such that the second peripheral side wall and the third peripheral side wall are substantially coterminous at both the second open and the second closed end of the dispensing cap, the third closed end of the rotating cap further including a plugging area having one or more raised protrusions and a receiving area having one or more openings, the one or more protrusions of the plugging area being capable of complementarily engaging the recessed cavities of the docking area and reversibly locking the rotating cap and the dispensing cap together in an open position; whereby the rotating cap can be rotated, unlocking the docking area of the dispensing cap and the plugging area of the rotating cap, and aligning the dispensing area and of the dispensing cap with the receiving area of the rotating cap to allow the cosmetic powder to be dispensed from the powder container into the rotating cap for use.

A second aspect of the present invention includes a rotatable cosmetic powder dispenser including a container having an open end and a removable lid, the container being capable of containing cosmetic powder; and a rotating means for dispensing the cosmetic powder, the rotating means including a first capable to be partially fitted into the container, the first cap having a first complementary engaging means and a first opening for dispensing the cosmetic powder; and a rotating second capable to be fitted into the first cap, the rotating second cap having a second opening for receiving the cosmetic powder and a second complementary engaging means being capable of complementarily engaging the first complementary engaging means of the first cap and reversibly locking the rotating second cap and the first cap together in an open position; whereby the rotating second cap can be rotated aligning the first opening with the second opening to allow the cosmetic powder to be dispensed into the rotating second cap for use. With such a configuration, an application surface is also provided at the inside bottom of the rotating cap where a user is able to apply the cosmetic powder evenly to a brush head and to manipulate the cosmetic powder evenly onto the brush head. By way of example, the dispensing area of the dispensing cap can include a plurality of closely spaced apart orifices and the receiving area of the rotating cap can include a single opening that is larger than the combined area of all the closely spaced apart orifices of the dispensing portion, such that a user can align all or a fraction of the receiving area of the rotating cap over all or a fraction of the number of closely spaced apart orifices of the dispensing area in order to dispense the desired amount of the cosmetic powder into the rotating cap for use. Furthermore, by way of example, the plugging area of the rotating cap can include a plurality of closely spaced apart raised protrusions that are complementary to the closely spaced apart orifices of the dispensing cap. This way, the one or more closely spaced apart raised protrusions of the plugging area are capable of complementarily engaging the plurality of closely spaced apart orifices of the dispensing cap and reversibly locking the rotating cap and dispensing cap together in a closed position where the cosmetic powder cannot fall outside of the powder container. For example, the recessed cavities and the orifices of the dispensing cap and the raised protrusions of the rotating cap can all be spaced apart in a triangular configuration wherein the raised protrusions of the rotating can complementarily engage the recessed cavities and the orifices of the dispensing cap in the open and the closed position respectively.

The rotating cap of the present invention can also include a guiding slot and the dispensing cap can also include a stopper, wherein the stopper can be position in the guiding slot thereby limiting the range of rotation of plugging area of the rotating cap to the area between the docking area and the dispensing area of the dispensing cap. The guiding slot and stopper can have any suitable configuration, for example the guiding slot can be a partial arch and the stopper can be a raised protrusion.

DETAILED DESCRIPTION OF THE INVENTION

Introduction

Figure 1:
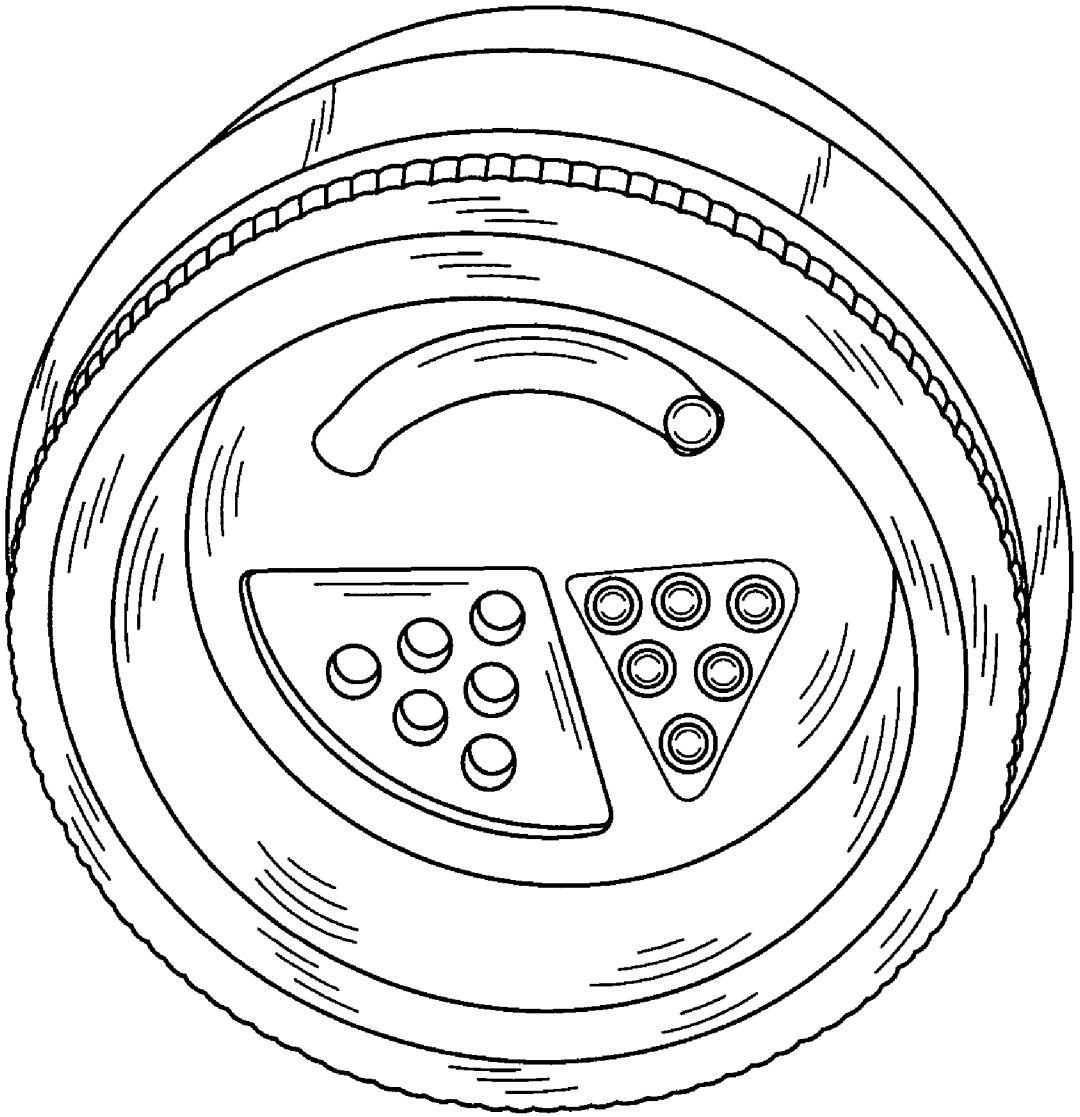
FIG. 1 is a perspective view of a rotating dispensing mechanism shown in an open or unlocked position.

The present invention recognizes that cosmetic powder containers and dispensers can be made more user friendly and cost effective by providing a cosmetic powder container with a rotatable dispensing mechanism to provide the ability to dispense only the desired amount of the cosmetic powder and at the same time provide an application surface for manipulating the cosmetic brush evenly onto the brush head.

Further objectives and advantages of the present invention will become apparent as the description proceeds and when taken in conjunction with the accompanying drawings. To gain a full appreciation of the scope of the present invention, it will be further recognized that various aspects of the present invention can changed or be combined to make desirable embodiments of the invention.

Unless defined otherwise, all technical and scientific terms used herein have the same meaning as commonly understood by one of ordinary skill in the art to which this invention belongs. Where a term is provided in the singular, the inventor also contemplates the plural of that term. The nomenclature used herein and the procedures described below are those well known and commonly employed in the art.

I. A Cosmetic Powder Container with Rotating Dispenser Mechanism

One embodiment of the present invention includes a cosmetic powder container with rotating dispenser mechanism. The present invention can be made from any suitable material, preferably rigid plastics, ceramics, glass, or a combination thereof. The present invention includes a powder container capable of containing cosmetic powder. The shape and size of the powder container may be as desired for a particular product, but it is preferred that the powder container include at least one open end and an opposing closed end having a peripheral side wall of a desire length such that the container is able to contain and house the cosmetic powder. The peripheral side wall of the cosmetic powder container preferably includes an attaching means for attaching to a removable lid. The attaching means may be any suitable attaching means for attaching an open-top container with a lid for securing its content, for example screw means, quick-release means, and snap-lock means.

The present invention also includes a rotating dispenser mechanism. Preferably, the rotating dispensing mechanism can be made from rigid plastics that allow the separate pieces to fit tightly within each other and have a smooth or partially smooth surfaces so that one piece can rotate over another piece. The rotating dispense mechanism of the present invention includes a dispensing cap which can fit tightly inside the powder container. The dispensing cap should include at least one open end and an opposing closed end having a peripheral side wall such that the closed end of the dispensing cap is able to fit tightly inside, but only partially down into the powder container, wherein the peripheral side wall of the powder container and the peripheral side wall of the dispensing cap are substantially coterminous at the open end of the powder container. This means that the dispensing cap fits partially down into the powder container leaving enough room at the bottom portion of the powder container for the powder where the side walls of the powder container and dispensing cap substantially end at the location at the end of their respective open ends. In order to ensure that the dispensing cap only partially fits down the powder container, the dispensing cap may be provided with a stopping lip that extends beyond and over the peripheral side wall of the powder container for stopping the dispensing cap partially down and inside the powder container, for example an annular stopping lip in the case of cylindrical shaped containers.

It is preferred that the dispensing cap include separate areas for performing different functions, such as, among other functions, dispending the cosmetic powder from the powder container through the dispensing cap. Thus, the dispensing cap may further include a docking area having one or more recessed cavities and a dispensing area having one or more orifices.

The present invention also includes a rotating cap which can fit inside the dispensing cap where the rotating cap is able to rotate inside the dispensing cap. The rotating cap should include at least one open end and an opposing closed end having a peripheral side wall such that the closed end of the rotating cap is able to substantially fit inside and be able to rotate within the dispensing cap. The peripheral side wall of the dispensing cap and the peripheral side wall of the rotating cap should be substantially coterminous at both the closed end of the dispensing cap and also at the open end of the dispensing cap, which means also substantially coterminous at the open end of the powder container. This means that the rotating cap fits substantially all the way down into the powder dispensing cap and is able to rotate therein. In such a configuration the side walls of the powder container, the dispensing cap, and the rotating cap are all substantially coterminous at the end of their respective open ends, while only the closed end of the rotating cap and the closed end of the dispensing cap are substantially coterminous and the closed end of the powder container and the closed end of the dispensing cap are separated by some distance in order to create a space for a volume of powder to be filled in the powder container. In order to ensure that the rotating cap fits substantially all the way down into the dispensing cap and is able to rotate therein, the rotating cap may be provided with an attaching lip that extends beyond and over the peripheral side wall of the dispensing cap and the powder container, for example an annular attaching lip with a short skirt that tightly hugs the side wall of the powder container in the case of cylindrical shaped containers.

It is preferred that the rotating cap include separate areas for performing different functions, such as, among other functions, receiving the cosmetic powder from the powder container through the dispensing cap. Thus, the rotating cap may further include a plugging area having one or more raised protrusions and a receiving area having one or more openings. The protrusions of the plugging area are preferably capable of complementarily engaging the recessed cavities of the docking area and reversibly locking the rotating cap and the dispensing cap together in an open position. The rotating cap can be inserted to sit inside the dispensing cap, where the bottom side of the rotating cap is in contact with the top side of the dispensing cap. The top side of the dispensing cap can include the recessed cavities of the docking area and the bottom side of the rotating cap can include the raised protrusions of the plugging area, wherein the raised protrusions of the rotating cap are complementary to the recessed cavities of the of the dispensing cap. In this manner, the rotating cap can be rotated, unlocking the docking area of the dispensing cap from the plugging area of the rotating cap, and aligning the dispensing area of the dispensing cap with the receiving area of the rotating cap to allow the cosmetic powder to be dispensed from the powder container into the rotating cap for use. The cosmetic powder can then be dispensed from the powder container, through the dispensing area of the dispensing cap aligned with the receiving area of the rotating cap, and onto the top surface of the rotating cap for a user to manipulate the cosmetic powder with a cosmetic brush to evenly load the cosmetic powder onto the brush head.

In one embodiment of the present invention, it is preferable that the dispensing area of the dispensing cap include a plurality of closely spaced apart orifices and the receiving area of the rotating cap include one opening that is larger than the combined area of all the closely spaced apart orifices of the dispensing portion, such that a user can align all or a fraction of the receiving area of the rotating cap over all or a fraction of the number of closely spaced apart orifices of the dispensing area in order to dispense the desired amount of the cosmetic powder into the rotating cap for use.

It is also preferred that the plugging area of the rotating cap comprises a plurality of closely spaced apart raised protrusions that are complementary to the closely spaced apart orifices of the dispensing cap, wherein the closely spaced apart raised protrusions of the plugging area are capable of complementarily engaging the plurality of closely spaced apart orifices of the dispensing cap and reversibly locking the rotating cap and dispensing cap together in a closed position.

In one example, the recessed cavities and the orifices of the dispensing cap and the raised protrusions of the rotating cap are all spaced apart in a triangular configuration wherein the raised protrusions of the rotating can complementarily engage the recessed cavities and the orifices of the dispensing cap in the open and the closed position respectively.

In another preferred embodiment of the present invention, the rotating cap may further include a guiding slot and the dispensing cap may further include a stopper, wherein the stopper can be position in the guiding slot thereby limiting the range of rotation of plugging area of the rotating cap to the area between the docking area and the dispensing area of the dispensing cap.

Some embodiments of the present invention, may further include a separable removable lock in order to lock the rotating cap in place and also lock in the cosmetic powder in side the powder container. For example, when a product is purchased new, the removable lock can be removed by the consumer ensuring that the product is new and also ensuring that the cosmetic powder did not spill out of the powder container during shipment. In this manner, the separate removal lock can be capable of complementarily engaging the one or more orifices of the dispensing area of the dispensing cap through the opening of the receiving area of the rotating cap.

II. A Rotatable Cosmetic Powder Dispenser

Another embodiment of the present invention includes a rotatable cosmetic powder dispenser including a container having an open end with a removable lid. The parts of the present invention can be made from any suitable material, preferably rigid plastics, ceramics, glass, or a combination thereof. The container of the present invention is capable of containing cosmetic powder, which includes a rotating means for dispensing the cosmetic powder on to a surface where a user can manipulate the cosmetic powder with a cosmetic brush to evenly load the cosmetic powder onto the brush head.

The rotating means of the present invention can include a two part cap including a stationary cap and a rotating cap wherein the rotating cap fits tightly within the stationary cap such that the bottom side of the rotating cap is in contact with the top side of the stationary cap. The bottom side of the rotating cap and the top side of stationary cap should have smooth or partially smooth surfaces so that one piece can rotate over another piece. The stationary cap may include a first complementary engaging means and an a first opening for dispensing the cosmetic powder, and similarly the rotating cap which fits into the stationary cap may have a second opening for receiving the cosmetic powder and a second complementary engaging means being capable of complementarily engaging the first complementary engaging means of the stationary cap and reversibly locking the rotating cap and the stationary cap together in an open position. In this manner the rotating cap can be rotated aligning the second opening of the rotating cap with the first opening of the stationary cap to allow the cosmetic powder to be dispensed from the container into the rotating second cap for use. It is preferred that the second complementary engaging means of the rotating can be capable of complementarily and reversibly engage the first complementary engaging means of the stationary cap in an open positions where the first and second openings are aligned for dispensing of the cosmetic powder, and in addition, it is preferred that the second complementary engaging means of the rotating cap be capable of complementarily and reversibly engage the first opening of the stationary cap in a closed position, in order to ensure that the cosmetic powder does not spill out while not in use.

In a preferred embodiment of the present invention, the stationary cap further includes a stopping lip for stopping the stationary cap partially inside the container, and the rotating cap further comprises an attaching lip capable of attaching to the container. In order to ensure that the rotating cap fits substantially all the way down into the stationary cap and is able to rotate therein, the rotating cap may include an attaching lip that extends beyond and over the peripheral side wall of the stationary cap and the powder container, for example an annular attaching lip with a short skirt that tightly hugs the side wall of the powder container in the case of cylindrical shaped containers.

In the present invention, the first opening can be configured to be complementary to the second engaging means, such that the second engaging means can complementarily engage the first opening and the first complementary engaging means in a closed and open position respectively.

In a preferred embodiment of the present invention, the rotating cap further includes a guiding slot and the first cap further includes a stopper, wherein the stopper can be position in the guiding slot thereby limiting the range of rotation of second engaging means to the area between the first engaging means and the first opening.

In some embodiments of the present invention, the second opening may include an area that is larger than the area of the first opening, such that a user can align all or a fraction of the area of the second opening over all or a fraction of the area first opening in order to dispense the desired amount of the cosmetic powder into the rotating second cap for use.

EXAMPLES

Example I

Cosmetic Powder Container with Rotating Dispenser Mechanism

Figure 2:
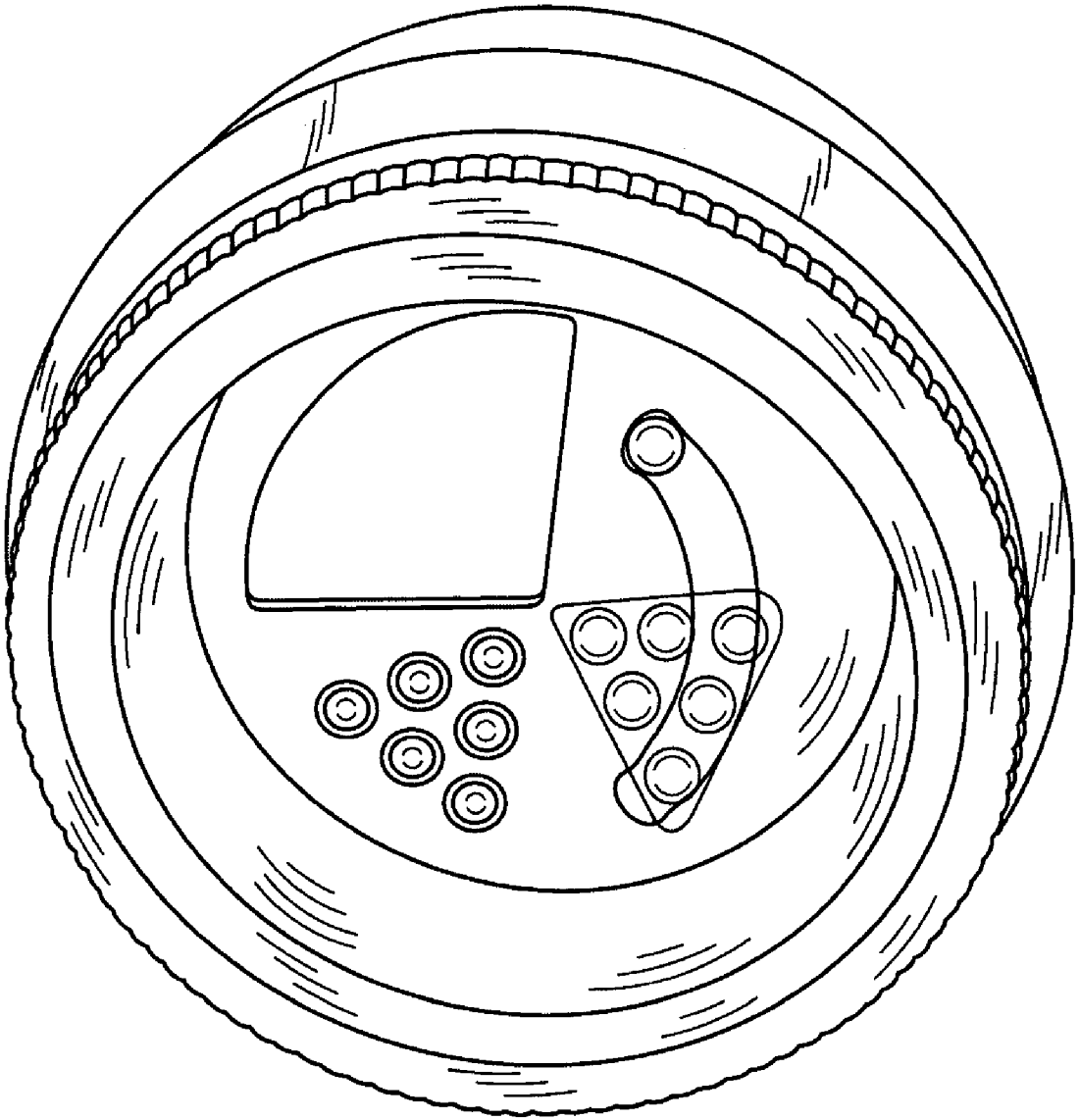
FIG. 2 is a perspective view of a rotating dispensing mechanism shown in a closed or locked position.
Figure 3:
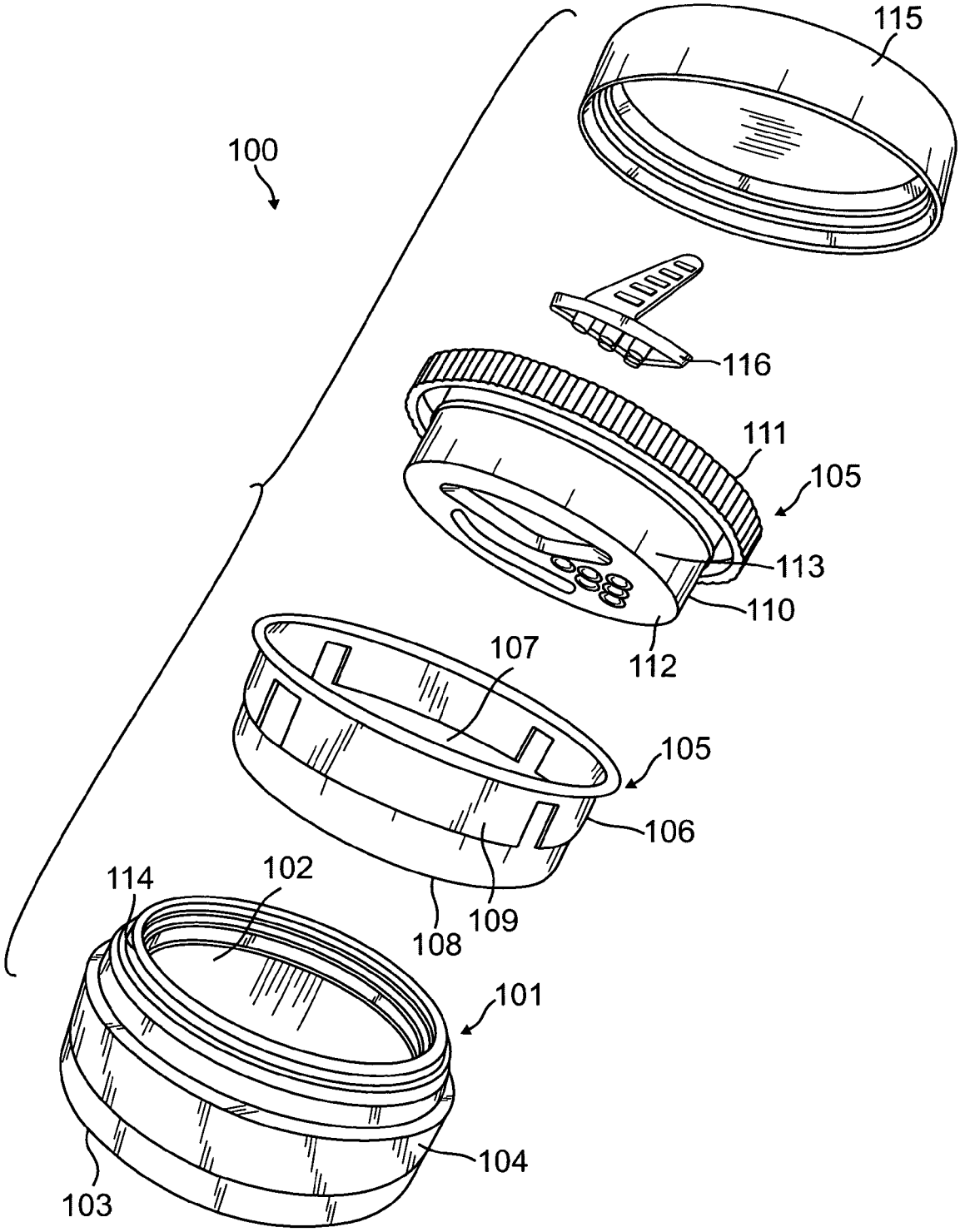
FIG. 3 is an exploded view of a cosmetic powder container with rotating dispenser mechanism with all of the parts.
Figure 4:
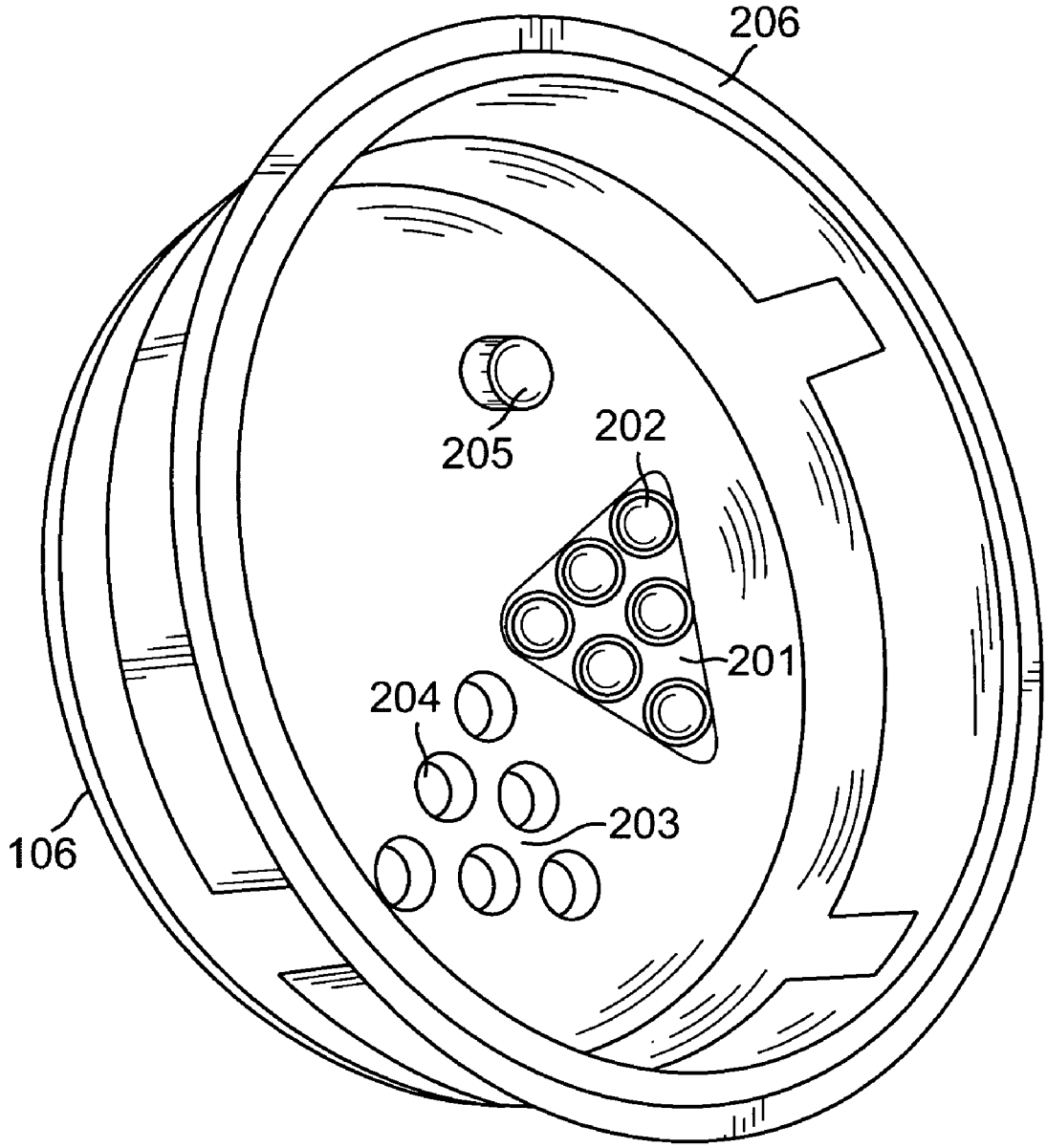
FIG. 4 is an inside perspective view of a dispensing cap.
Figure 5:
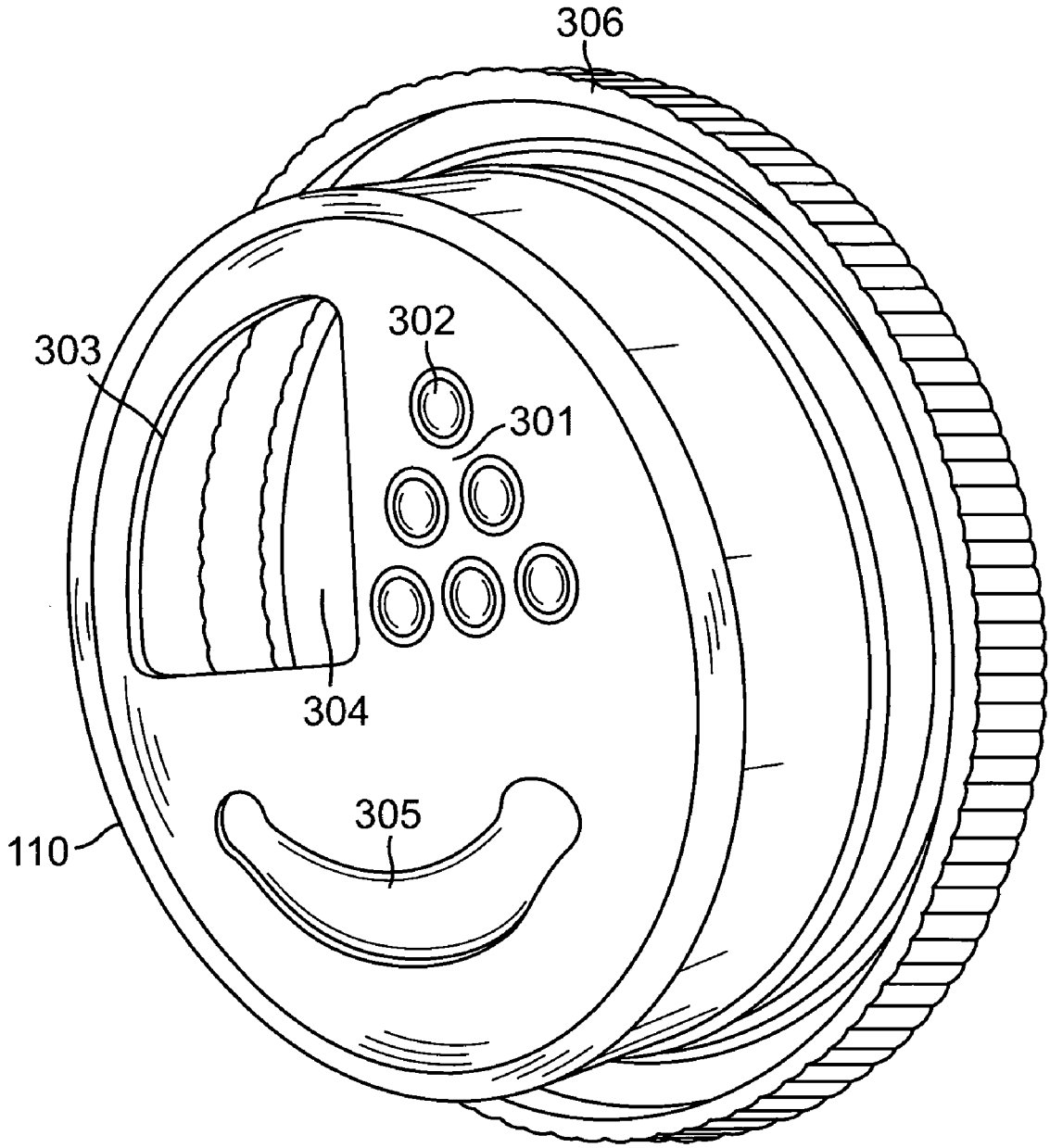
FIG. 5 is a bottom perspective view of a rotating cap.

Referring to FIGS. 1 through 5, one embodiment of the aspect of the present invention includes a cosmetic powder container with rotating dispenser mechanism 100 including a powder container 101 capable of containing cosmetic powder, the powder container 101 including a first open end 102 and an opposing first closed end 103 having a first peripheral side wall 104 having attaching means 114 for attachment to a removable lid 115. The present invention also includes a two part rotating dispenser mechanism 105 including a dispensing cap 106 including a second open end 107 and an opposing second closed end 108 having a second peripheral side wall 109, wherein the second closed end 108 is adapted to fit inside the first open end 102 and partially down the first peripheral side wall 104 of the powder container 101, such that the first peripheral side wall 104 and the second peripheral side wall 109 are substantially coterminous at the first open end 102 of the powder container 101, the second closed end 108 of the dispensing cap 106 further including a docking area 201 having one or more recessed cavities 202 and a dispensing area 203 having one or more orifices 204; and a rotating cap 110 including a third open end 111 and an opposing third closed end 112 having a third peripheral side wall 113, wherein the rotating cap 110 is adapted to fit inside the second open end 107 of the dispensing cap 106, such that the second peripheral side wall 109 and the third peripheral side wall 113 are substantially coterminous at both the second open end 107 and the second closed end 108 of the dispensing cap 106, the third closed end 112 of the rotating cap 110 further including a plugging area 301 having one or more raised protrusions 302 and a receiving area 303 having one or more openings 304, the one or more protrusions 302 of the plugging area 301 being capable of complementarily engaging the recessed cavities 202 of the docking area 201 and reversibly locking the rotating cap 110 and the dispensing cap 106 together in an open position; whereby the rotating cap 110 can be rotated, unlocking the docking area 201 of the dispensing cap 106 and the plugging area 301 of the rotating cap 110, and aligning the dispensing area 203 of the dispensing cap 106 with the receiving area 303 of the rotating cap 110 to allow the cosmetic powder to be dispensed from the powder container 101 into the rotating cap 110 for use.

The rotating cap 110 of the present invention can also include a guiding slot 305 and the dispensing cap 106 can also include a stopper 205, wherein the stopper 205 can be position in the guiding slot 305 thereby limiting the range of rotation of plugging area 301 of the rotating cap 110 to the area between the docking area 201 and the dispensing area 203 of the dispensing cap 106.

In order to ensure a proper fit of the parts of the present invention, the dispensing cap 106 can include a stopping lip 206 at the first open end 102 of the second peripheral side wall 109 stopping the dispensing cap 106 inside the powder container 101 at a partial distance down the first peripheral side wall 104 of the powder container 101, and the rotating cap 110 may include an attaching lip 306 capable of attaching to the first open end 102 of the first peripheral side wall 104 of the powder container 101.

The present invention may also include a separable removable lock 116 capable of complementarily engaging the one or more orifices 204 of the dispensing area 203 of the dispensing cap 106 through the opening of the receiving area 303 of the rotating cap 110.

All headings are for the convenience of the reader and should not be used to limit the meaning of the text that follows the heading, unless so specified. Various changes and departures may be made to the present invention without departing from the spirit and scope thereof. Accordingly, it is not intended that the invention be limited to that specifically described in the specification or as illustrated in the drawings, but only as set forth in the claims. Although the invention has been described and illustrated with respect to exemplary embodiments thereof, it should be understood by those skilled in the art that the foregoing and various other changes, omissions, and additions may be made therein and thereto, without parting from the spirit and scope of the present invention.

What is claimed is:

1. A cosmetic powder container with rotating dispenser mechanism comprising:

a powder container capable of containing cosmetic powder, the powder container comprising a first open end and an opposing first closed end comprising a first peripheral side wall comprising attaching means for attachment to a removable lid; and a rotating dispenser mechanism comprising:

a dispensing cap comprising a second open end and an opposing second closed end comprising a second peripheral side wall, wherein the second closed end is adapted to fit inside the first open end and partially down the first peripheral side wall of the powder container, such that the first peripheral side wall and the second peripheral side wall are substantially coterminous at the first open end of the powder container, the second closed end of the dispensing cap further comprising docking area comprising one or more recessed cavities and a dispensing area comprising one or more orifices; and a rotating cap comprising a third open end and an opposing third closed end comprising a third peripheral side wall, wherein the rotating cap is adapted to fit inside the second open end of the dispensing cap, such that the second peripheral side wall and the third peripheral side wall are substantially coterminous at both the second open end and the second closed end of the dispensing cap, the third closed end of the rotating cap further comprising a plugging area comprising one or more raised protrusions and a receiving area comprising one or more openings, the one or more protrusions of the plugging area being capable of complementarily engaging the recessed cavities of the docking area and reversibly locking the rotating cap and the dispensing cap together in an open position;

whereby the rotating cap can be rotated, unlocking the docking area of the dispensing cap and the plugging area of the rotating cap, and aligning the dispensing area and of the dispensing cap with the receiving area of the rotating cap to allow the cosmetic powder to be dispensed from the powder container into the rotating cap for use.

2. The cosmetic powder container of claim 1, wherein the dispensing area of the dispensing cap comprises a plurality of closely spaced apart orifices and the receiving area of the rotating cap comprises one opening that is larger than the combined area of all the closely spaced apart orifices of the dispensing portion, such that a user can align all or a fraction of the receiving area of the rotating cap over all or a fraction of the number of closely spaced apart orifices of the dispensing area in order to dispense the desired amount of the cosmetic powder into the rotating cap for use.

3. The cosmetic powder container of claim 2, wherein the plugging area of the rotating cap comprises a plurality of closely spaced apart raised protrusions that are complementary to the closely spaced apart orifices of the dispensing cap, the one or more closely spaced apart raised protrusions of the plugging area being capable of complementarily engaging the plurality of closely spaced apart orifices of the dispensing cap and reversibly locking the rotating cap and dispensing cap together in a closed position.

4. The cosmetic powder container of claim 3, wherein the recessed cavities and the orifices of the dispensing cap and the raised protrusions of the rotating cap are all spaced apart in a triangular configuration wherein the raised protrusions of the rotating can complementarily engage the recessed cavities and the orifices of the dispensing cap in the open and the closed position respectively.

5. The cosmetic powder container of claim 3, wherein the rotating cap further comprises a guiding slot and the dispensing cap further comprises a stopper, wherein the stopper can be position in the guiding slot thereby limiting the range of rotation of plugging area of the rotating cap to the area between the docking area and the dispensing area of the dispensing cap.

6. The cosmetic powder container of claim 4, wherein the dispensing cap further comprises a stopping lip at the end of the second peripheral side wall stopping the dispensing cap inside the powder container at a partial distance down the first peripheral side wall of the powder container, and the rotating cap further comprises an attaching lip capable of attaching to the end of the first peripheral side wall of the powder container.

7. The cosmetic powder container of claim 4, further comprising a separable removable lock capable of complementarily engaging the one or more orifices of the dispensing area of the dispensing cap through the opening of the receiving area of the rotating cap.

8. A rotatable cosmetic powder dispenser comprising:

a container comprising an open end and a removable lid, the container capable of containing cosmetic powder; and a rotating means for dispensing the cosmetic powder, the rotating means comprising:

a first cap able to be partially fitted into the container, the first cap comprising a first complementary engaging means and a first opening for dispensing the cosmetic powder; and a rotating second cap able to be fitted into the first cap, the rotating second cap comprising a second opening for receiving the cosmetic powder and a second complementary engaging means being capable of complementarily engaging the first complementary engaging means of the first cap and reversibly locking the rotating second cap and the first cap together in an open position;

whereby the rotating second cap can be rotated aligning the first opening with the second opening to allow the cosmetic powder to be dispensed into the rotating second cap for use;

wherein the first cap further comprises a stopping lip for stopping the first cap partially inside the container, and the rotating second cap further comprises an attaching lip capable of attaching to the container.

9. The rotatable cosmetic powder dispenser of claim 8, wherein the first opening is configure to be complementary to the second engaging means, such that the second engaging means can complementarily engage the first opening and the first complementary engaging means in a closed and open position respectively;

wherein the rotating second cap further comprises a guiding slot and the first cap further comprises a stopper, wherein the stopper can be position in the guiding slot thereby limiting the range of rotation of second engaging means to the area between the first engaging means and the first opening.

* * * * *